US006211751B1

(12) United States Patent
Aoki

(10) Patent No.: US 6,211,751 B1
(45) Date of Patent: Apr. 3, 2001

(54) MICROSTRIP BROADBAND BALUN WITH FOUR GROUND PLATES

(75) Inventor: Katsuhiko Aoki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/356,325

(22) Filed: Jul. 16, 1999

(30) Foreign Application Priority Data

Apr. 6, 1999 (JP) ..... PCT/JP99/01818

(51) Int. Cl.[7] ..... H01P 5/10
(52) U.S. Cl. ..... 333/26; 333/33; 333/246
(58) Field of Search ..... 333/25, 26, 21 A, 333/33, 246; 343/859

(56) References Cited

U.S. PATENT DOCUMENTS 2,107,025 * 2/1938 Buschbeck et al. ..... 333/25
2,754,484 * 7/1956 Adams ..... 333/246 X
5,450,093 * 9/1995 Kim ..... 343/859 X
5,471,181 * 11/1995 Park ..... 333/246

FOREIGN PATENT DOCUMENTS

2087653 * 5/1982 (GB) ..... 333/26
63-209201 * 8/1988 (JP) ..... 333/26

* cited by examiner

*Primary Examiner*—Justin P. Bettendorf
(74) *Attorney, Agent, or Firm*—Rothwell, Figg, Ernst & Manbeck

(57) ABSTRACT

A balun is used in electric communications for supplying power to a balanced line from an unbalanced circuit, a power feeder consisting of a microstrip line. Two microstrip center conductors are connected to the balanced line, and are supplied with signals of opposite phases. This makes it possible to convert an unbalanced current flowing through the microstrip line to a balanced current flowing through the balanced line.

2 Claims, 13 Drawing Sheets

A-A CROSS SECTION

MICROSTRIP BROADBAND BALUN WITH FOUR GROUND PLATES

BACKGROUND OF THE INVENTION

1. Field of the Invention

The present invention relates to a balun used in telecommunications for feeding electric power to a balanced line from an unbalanced circuit, a power feeder consisting of a microstrip line.

2. Description of Related Art

When using a high frequency band in telecommunications, a microstrip line is often employed as a transmission line for conveying a signal. On the other hand, there is a balanced circuit such as an antenna for transmitting or receiving the signal by radio via space. A balun is used to connect such a balanced circuit with the microstrip line.

FIG. 18 shows a conventional balun. In FIG. 18, the reference numeral 1 designates a balanced line; and 2 designates a microstrip center conductor of a microstrip line which constitutes an unbalanced circuit together with a ground plate not shown to transmit a signal. The reference numeral 3 designates a connecting point of the balanced line 1 and microstrip center conductor 2; and 4 designates an additional line for short-circuiting the balanced line 1 at a position one quarter wavelength apart from the connecting point 3. The reference numeral 5 designates a grounding terminal for grounding the balanced line 1 at a position half wavelength apart from the connecting point 3. Because the balanced line 1 is terminated by the short-circuit at one quarter wavelength apart and by the ground at half wavelength apart from the connecting point 3 on the additional line 4 side, a current (unbalanced current) fed from the microstrip center conductor 2 is transformed to a current (balanced current) flowing through the balanced line 1 in opposite directions. With such a structure, the conventional balun must comprise on the balanced line additional circuits such as the quarter-wave transmission line, half-wave transmission line and additional transmission line, and this presents a problem of increasing the dimension of the structure. Furthermore, because the additional circuits are determined in accordance with the wavelength of the signal to be transmitted, and cannot transform signals of other frequencies from an unbalanced to balanced current, a problem arises of restricting the application of the balun fabricated to a particular frequency.

The present invention is implemented to solve the problems. Therefore, an object of the present invention is to provide a compact, rather frequency independent balun.

SUMMARY OF THE INVENTION

According to a first aspect of the present invention, there is provided a balun comprising: a balanced line including a first conductor and a second conductor; a first microstrip center conductor connected to the first conductor of the balanced line; and a second microstrip center conductor connected to the second conductor of the balanced line for supplying the second conductor with a current with a phase opposite to a phase of a current flowing through the first conductor. This makes it possible to reduce the size of the balun because it is unnecessary to provide the additional circuit on the balanced line, and to apply the balun to signals with different frequencies.

Here, the first microstrip center conductor may be formed on one side of a ground plate, and the second microstrip center conductor may be formed on the other side of the ground plate. This makes it possible to simplify the structure of the balun.

The second microstrip center conductor may comprise a delay circuit for delaying an radio wave propagating through the second microstrip center conductor by half wave. This obviates the need for preparing the input signal to the balun with the opposite phase, thereby simplifying an input interface.

The balun may further comprise a feeder for supplying power from the first microstrip center conductor to the second microstrip center conductor through a hole provided in the ground plate. This makes it possible to reduce the input signal to the balun to a single signal.

The balun may further comprise a ground plate of the first microstrip center conductor, a ground plate of the second microstrip center conductor, and a conductor for connecting the two ground plates which are mounted in parallel. This enables the balun to have a space therein.

The first microstrip center conductor and the second microstrip center conductor may be mounted on a side face of a cylindrical groundplate via a dielectric layer. This enables the balun to have a circular space therein.

The balun may further comprise a ground plate on a surface of which the first microstrip center conductor and the second microstrip center conductor are each mounted via a dielectric layer. This makes it possible to form the unbalanced circuit section of the balun on the plane.

The balun may further comprise a ground plate of the first microstrip center conductor, a ground plate of the second microstrip center conductor and a conductor for connecting the two ground plates which are mounted separately on a plane. This makes it possible to form the unbalanced circuit section of the balun on the plane, and to form a space within the balun.

According to a second aspect of the present invention, there is provided a balun comprising a plurality balun components, each of which includes: a balanced line including a first conductor and a second conductor; a first microstrip center conductor connected to the first conductor of the balanced line; and a second microstrip center conductor connected to the second conductor of the balanced line for supplying the second conductor with a current with a phase opposite to a phase of a current flowing through the first conductor, wherein two phases of an radio wave fed to one of the balun components differ from two phases of an radio wave fed to another of the balun components. This makes it possible to rotate the plane of polarization of the radio wave which is radiated from the balanced line.

The one of the balun components may comprise for its two microstrip center conductors two ground plates which are facing to each other, and the another of the balun components may comprise for its two microstrip center conductors two ground plates which are facing to each other and are disposed alternately with the ground plates of the one of the balun components, wherein the four ground plates adjacent to each other may be connected by a conductor. This makes it possible to reduce the size of the individual conductors for connecting the ground plates.

The four microstrip center conductors of the one of the balun components and of the another of the balun components may be connected to one microstrip center conductor and three microstrip center conductors each including a delay line branching from the one microstrip center conductor. This makes it possible to simplify the signal input interface.

According to a third aspect of the present invention, there is provided a balun comprising: a balanced line including a first conductor and a second conductor; a microstrip center conductor connected to the first conductor of the balanced line; and a quarter-wave long conductor plate which is connected at its first edge to a ground plate of the microstrip center conductor and at its second edge to the second conductor of the balanced line. This enables the microstrip center conductor to be reduced to one, thereby improving the productivity.

The conductor plate may connected to the ground plate via a quarter-wave long conductor plate facing the ground plate. This enables the balun to have a space in its unbalanced circuit section.

DETAILED DESCRIPTION OF THE PREFERRED EMBODIMENTS

The invention will now be described with reference to the accompanying drawings.

EMBODIMENT 1

Figure 1A:
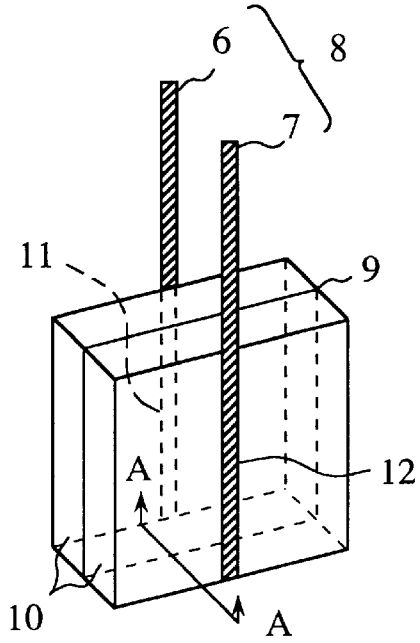
FIGS. 1A and 1B are a perspective view and a cross-sectional view showing an embodiment 1 of a balun in accordance with the present invention.
Figure 1B:
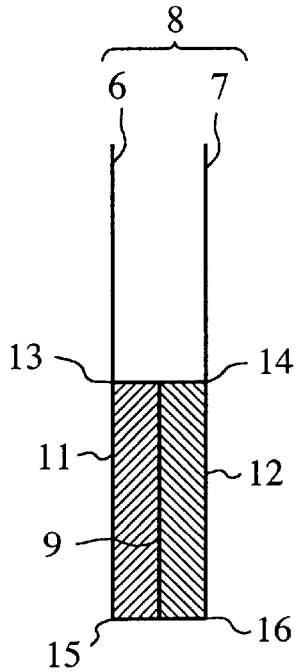

FIGS. 1A and 1B are a perspective view and a cross-sectional view showing a structure of an embodiment 1 of a balun in accordance with the present invention. In FIG. 1A, reference numerals 6 and 7 designate parallel conductors; and the reference numeral 8 designates a parallel-wire balanced line consisting of the conductors 6 and 7. The reference numeral 9 designates a ground plate of a microstrip line; 10 designates dielectric layers formed on both side of the ground plane 9; and reference numerals 11 and 12 each designate a microstrip center conductor formed on the dielectric layers. In FIG. 1B, the reference numeral 13 designates a connecting point of the conductor 6 of the balanced line and the microstrip center conductor 11; and 14 designates a connecting point of the conductor 7 of the balanced line and the microstrip center conductor 12. Reference numerals 15 and 16 designate signal input terminals to the microstrip center conductors 11 and 12. The ground plane 9 is common to the microstrip center conductors 11 and 12, so that the structure as shown in FIGS. 1A and 1B couples the unbalanced circuit consisting of the microstrip center conductors 11 and 12 to the balanced line 8 including the conductors 6 and 7.

Figure 2:
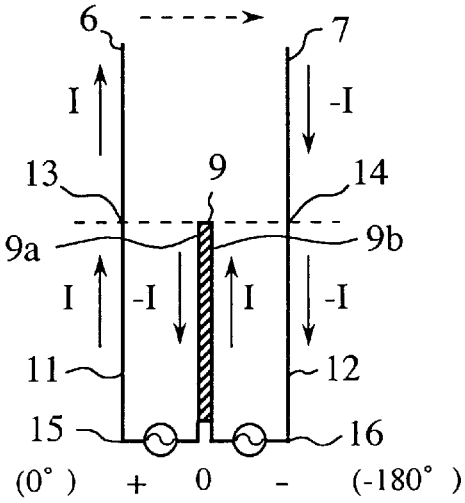
FIG. 2 is a schematic diagram illustrating the operation of the embodiment 1 of the balun in accordance with the present invention.

The operation of the converter will now be described with reference to FIG. 2. Signals of opposite phases with 0 and −180 degrees are applied to the signal input terminals 15 and 16. Assume that the signal is fed to the signal input terminal 15, and a current I flows through the microstrip center conductor 11 in the direction as shown in FIG. 2. In this case, a current −I flows through a surface 9*a* of the ground plane 9 on the side of the microstrip center conductor 11. The signal of the opposite phase applied to the signal terminal 16 causes a current −I to flow through the microstrip center conductor 12, which causes a current I to flow through a surface 9*b* of the ground plane 9 on the side of the microstrip center conductor 12. The current I flowing through the microstrip center conductor 11 flows into the conductor 6 of the balanced line 8 via the connecting point 13, which causes a current −I to flow through the other conductor 7 of the balanced line 8 through a displacement current across the conductors 6 and 7. The current −I flowing through the conductor 7 is connected to the current −I flowing through the microstrip center conductor 12. Thus, the current I flows through the closed loop in the converter, and the current (balanced current) flows through the conductors 6 and 7 in the opposite direction in the balanced line 8. As a result, the unbalanced current flowing through the microstrip line can be converted into the balanced current.

With such an arrangement, the balun can achieve conversion from the microstrip line to the balanced line without using the half-wave transmission line, quarter-wave transmission line and additional line which are needed for the balanced line in the conventional technique, thereby reducing the size of the balun. In addition, because the structural components are independent of the frequency, the balun is independent of the frequency of the input signal, which makes it possible to increase the frequency range of the input signal.

Figure 3A:
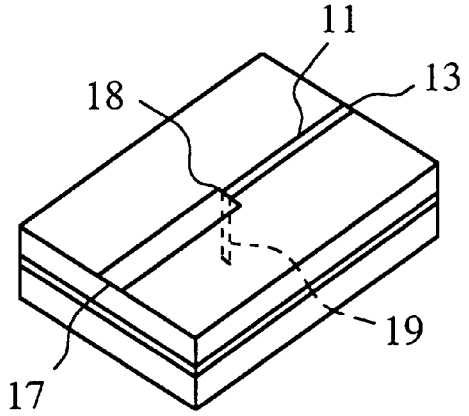
FIGS. 3A–3C are a perspective view, a cross-sectional view and a perspective view showing another structure of the embodiment 1 of the balun in accordance with the present invention with an additional delay line.
Figure 3B:
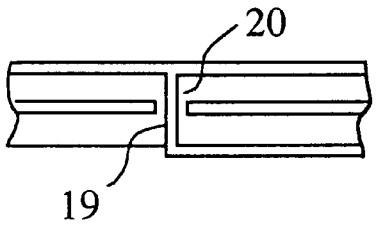
Figure 3C:
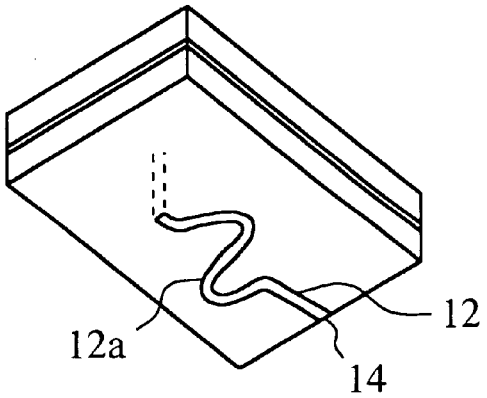

Furthermore, the balanced conversion can also be achieved by providing a delay circuit on the microstrip line as shown in FIGS. 3A–3B. In FIG. 3A, the reference numeral 17 designates a signal input terminal, 18 designates a splitting point, and 19 designates a connecting conductor passing through the dielectric layer and the ground plate. In FIG. 3B, the reference numeral designates a hole made through the ground plate; and in FIG. 3C, the reference numeral 12*a* designates a half-wave delay circuit. A signal applied to the signal input terminal 17 is delivered at the splitting point 18 to the microstrip center conductor 11 shown in FIG. 3A and to the microstrip center conductor 12 shown in FIG. 3C. The signal fed from the splitting point 18 to the microstrip center conductor 12 passes through the connecting conductor 19. The hole 20 through the ground plate is provided so that the connecting conductor 19 passes through the dielectric layer and the ground plate to apply the signal to the microstrip center conductor 12. Because of the half-wave delay circuit 12*a* connected with the microstrip center conductor 12, the signal passing through the microstrip center conductor 12 has the phase opposite to the signal passing through the microstrip center conductor 11. This circuit as shown in FIGS. 3A–3C is connected to the balanced line via the connecting points 13 and 14. With the foregoing structure, the number of the signal input terminals is reduced to one, which simplifies the signal input.

A structure is also possible which provides one of the two microstrip center conductors with a half-wave delay circuit without the connecting conductor 19. Although this structure requires two signal input terminals, they can be provided with the signal of the same phase. This has an advantage of being able to obviate the necessity for a pre-stage circuit of the balun for generating the opposite phase signals.

EMBODIMENT 2

Figure 4A:
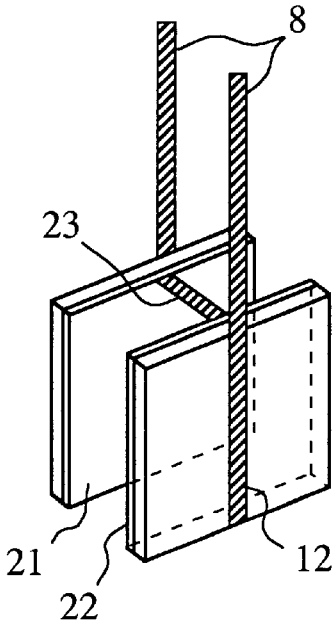
FIGS. 4A–4C are a perspective view, a cross-sectional view and a schematic operational diagram showing an embodiment 2 of the balun in accordance with the present invention.
Figure 4B:
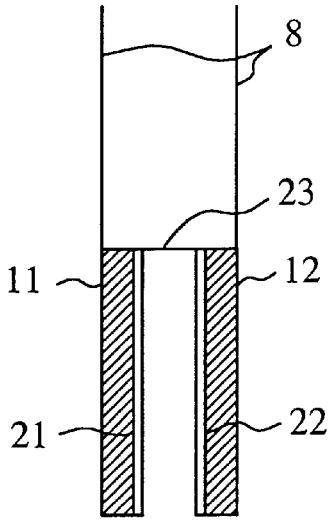
Figure 4C:
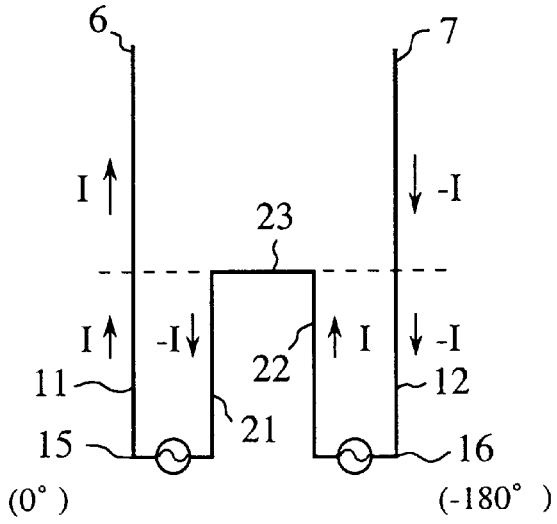

FIGS. 4A–4C are views showing another structure of the balun in accordance with the present invention. In FIGS. 4A and 4B, the reference numeral 21 designates a ground plate for the microstrip center conductor 11; 22 designates a ground plate for the microstrip center conductor 12; and 23 designates a connecting conductor for connecting the ground plates 21 and 22.

In FIG. 4C, assume that the signal input terminals 15 and 16 are supplied with signals of opposite phases, and that a current I flows through the microstrip center conductor 11 in the direction as shown in FIG. 4C. In this case, a current –I flows through the ground plate 21. The signal of the opposite phase applied to the signal point 16 causes a current –I to flow through the microstrip center conductor 12, which in turn causes a current I to flow through the ground plate 22. The current I flowing through the microstrip center conductor 11 flows into the conductor 6 of the balanced line 8, which causes a current –I to flow through the other conductor 7 of the balanced line 8 through a displacement current across the conductors 6 and 7. The current –I flowing through the conductor 7 is connected to the current –I flowing through the microstrip center conductor 12. Thus, the current I flows through the closed loop via the connecting conductor 23 connecting the ground plates 21 and 22. As a result, the current (balanced current) flows through the conductors 6 and 7 in the opposite direction in the balanced line 8, and hence the unbalanced current flowing through the microstrip line can be converted into the balanced current.

With such an arrangement, the balun can achieve conversion from the microstrip line to the balanced line without using the half-wave transmission line, quarter-wave transmission line and additional line which are needed for the balanced line in the conventional technique, thereby reducing the size of the balun. In addition, because the structural components are independent of the frequency, the balun is independent of the frequency of the input signal, which makes it possible to increase the frequency range of the input signal. Furthermore, a space can be provided in the balun by separating the two ground plates 21 and 22. The spacing between the conductors 6 and 7 of the balanced line 8 can be varied by adjusting the spacing between the ground plates 21 and 22 independently of the spacing between the microstrip center conductor 11 and the ground plate 21, and of the spacing between the microstrip center conductor 12 and the ground plate 22.

Figure 5:
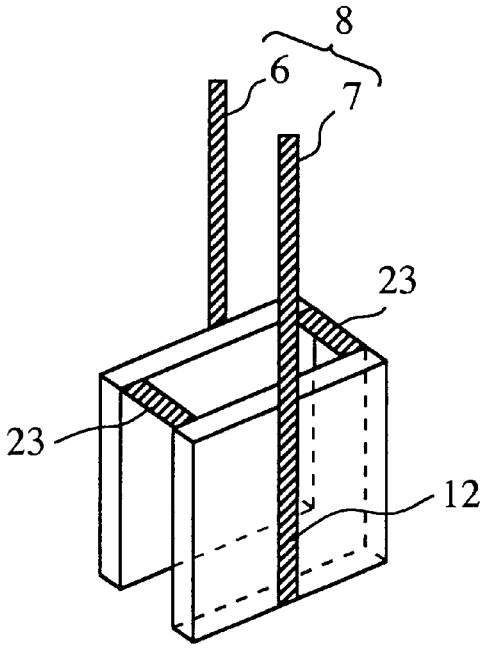
FIG. 5 is a perspective view showing another structure of the embodiment 2 of the balun in accordance with the present invention.

Alternatively, connecting conductors 23 for connecting the ground plates can be placed apart from the balanced line 8 as shown in FIG. 5. In this case also, the current flowing through the balun forms a closed loop as in the above. This causes a balanced current to flow through the balanced line 8, offering the same advantage as the foregoing.

Figure 6:
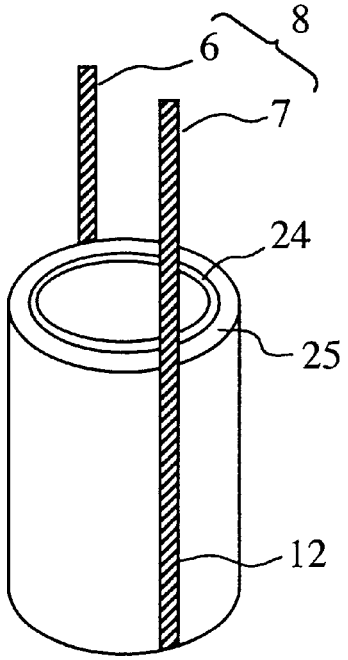
FIG. 6 is a perspective view showing a still another structure of the embodiment 2 of the balun in accordance with the present invention.

Besides, the ground plate can have a cylindrical structure as shown in FIG. 6, in which the reference numeral 24 designates a cylindrical ground plate, and 25 designates a dielectric layer formed on an outer surface of the ground plate 24. The balun is constructed by forming the microstrip lines on the dielectric layer 25, and by connecting them to the balanced line 8. In this case also, the current flowing through the balun forms a closed loop as in the above. This causes a balanced current to flow through the balanced line 8, offering the same advantage as the foregoing.

EMBODIMENT 3

Figure 7:
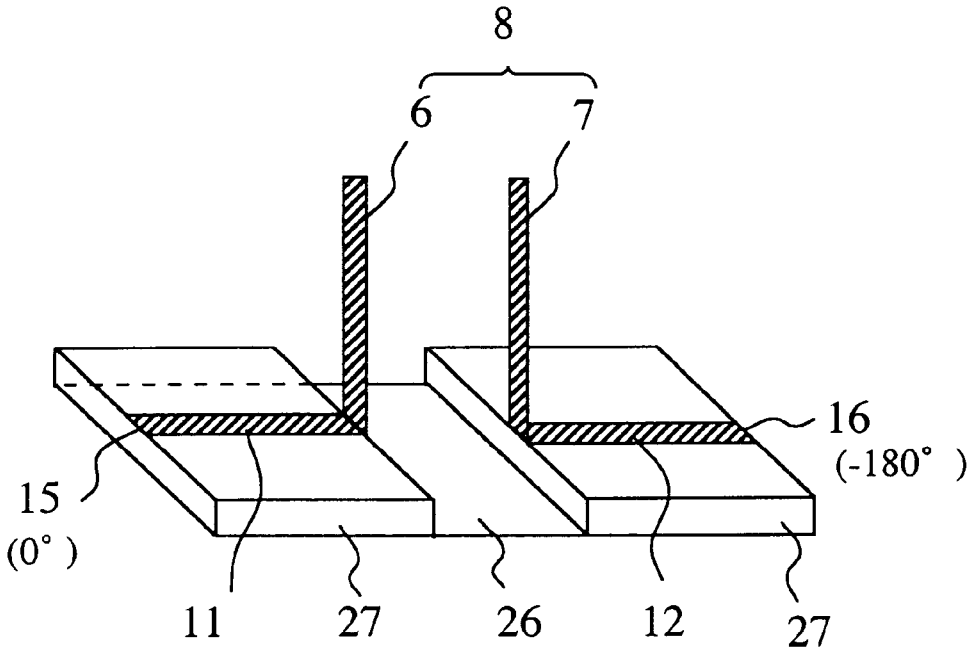
FIG. 7 is a perspective view showing an embodiment 3 of the balun in accordance with the present invention.

FIG. 7 is a perspective view showing another structure of the balun in accordance with the present invention. In FIG. 7, the reference numeral 26 designates a ground plate, and 27 each designate one of two dielectric layers formed on a surface of the ground plate 26. The microstrip center conductors 11 and 12 are formed on the dielectric layers 27, respectively, and are connected to the balanced line 8.

Supplying the signal input terminals 15 and 16 with signals opposite in phase causes currents to flow through the microstrip center conductors 11 and 12, which induces currents flowing in the same direction through portions of the ground plate 26 facing the transmission lines, thereby causing a current to flow through the ground plate 26 in one direction. The unbalanced currents flowing through the microstrip center conductors 11 and 12 flow into the conductors 6 and 7 of the balanced line 8, thereby generating in the conductors 6 and 7 balanced currents equal in magnitude and opposite in direction. Because the unbalanced circuit section, which comprises the ground plate 26, dielectric layers 27 and microstrip center conductors 11 and 12, is formed on the ground plate 26, it can be made thinner.

Figure 8:
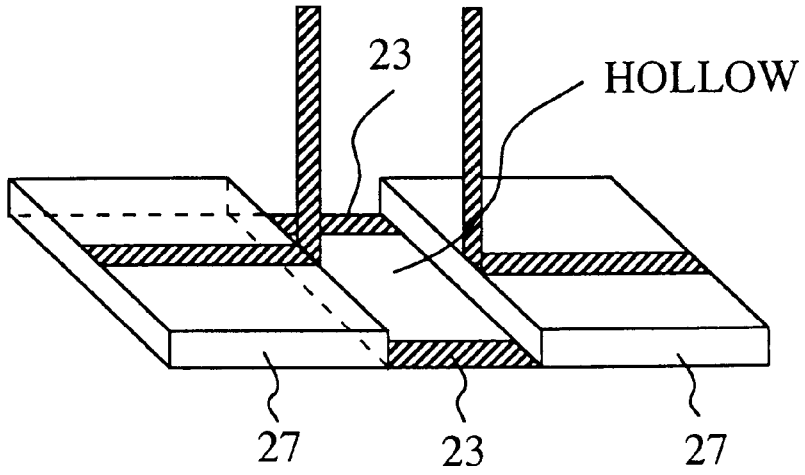
FIG. 8 is a perspective view showing another structure of the embodiment 3 of the balun in accordance with the present invention.

Alternatively, as shown in FIG. 8, the ground plate 27 can be separately provided for each of the microstrip center conductors 11 and 12, and the ground plates can be connected by the connecting conductors 23. This enables the currents flowing through the ground plates to flow in one direction through the connecting conductors 23. With such an arrangement, the unbalanced circuit portion can be made thinner, and besides, a hollow space can be established in the unbalanced circuit portion between the two conductors of the balanced line 8.

EMBODIMENT 4

Figure 9A:
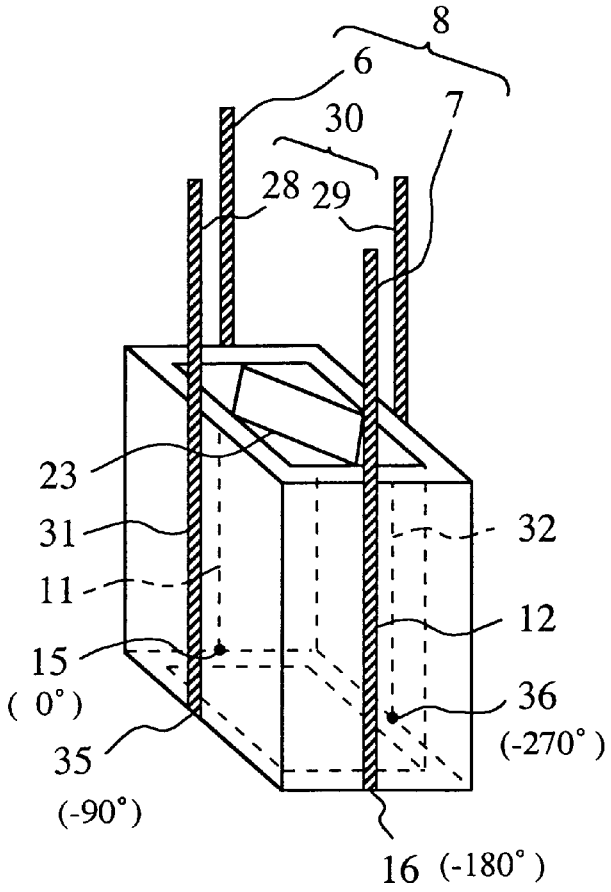
FIGS. 9A and 9B are a perspective view and a cross-sectional view showing an embodiment 4 of the balun in accordance with the present invention.
Figure 9B:
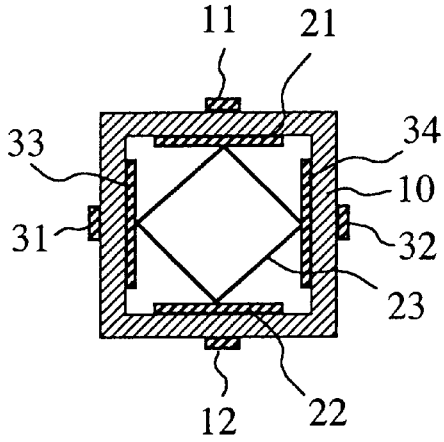

FIGS. 9A and 9B are views showing another arrangement of the balun in accordance with the present invention: FIG. 9A is a perspective view; and FIG. 9B is a cross-sectional view of a rectangular tube, in which reference numerals 28 and 29 designate a pair of conductors, and 30 designates a balanced line consisting of the conductors 28 and 29. Thus, the arrangement in the figures includes two pairs of the balanced lines: one is the balanced line 8 consisting of the conductors 6 and 7; and the other is the balanced line 30 consisting of the conductors 28 and 29. Reference numerals 31 and 32 designate microstrip center conductors, which are connected to the conductors 28 and 29, respectively. Reference numerals 33 and 34 designate ground plates corresponding to microstrip center conductors 31 and 32, respectively, which are formed on the dielectric layer 10. A connecting conductor 23 for interconnecting the ground plates 21, 22, 33 and 34 connect the adjacent ground plates. Reference numerals 35 and 36 designate signal input terminals of the microstrip center conductors 31 and 32. The signal input terminals of the microstrip center conductors 11 and 12 are designated by reference numerals 15 and 16. In FIG. 9A, the balanced lines 8 and 30 are disposed such that surfaces including their conductors are orthogonal to each other, and the rectangular tube has a square cross section as shown in FIG. 9B.

Next, the operation of the balun as shown in FIGS. 9A and 9B will be described. As described before in connection with the structure of the embodiment 2 as shown in FIGS. 4A–4C, the signals opposite in phase cause balanced currents to appear in the conductors 6 and 7 of the balanced line 8, when they are applied to the signal input terminals 15 and 16 of the balun comprising the balanced line 8, microstrip center conductors 11 and 12, ground plates 21 and 22 and connecting conductor 23. On the other hand, signals opposite in phase cause balanced currents to appear in the conductors 28 and 29 of the balanced line 30, when they are applied to the signal input terminals 35 and 36 of the balun comprising the balanced line 30, microstrip center conductors 31 and 32, ground plates 33 and 34 and connecting conductor 23. When the signals applied to the signal input terminals 15, 35, 16 and 36 have a phase shifted by 90 degrees each, the phases of the displacement currents induced in the balanced lines 8 and 30 are shifted by 90 degrees. Thus, when sinusoidal waves are applied to the signal input terminals, it will be seen that the composite vector of the displacement currents in the balanced lines 8 and 30 rotates. With such an arrangement, the balun can not only convert the unbalance current to balanced current, but also generate a circularly polarized wave because of the rotation of the displacement current in the balanced lines.

Although the ground plates 21 and 22, and 33 and 34 are placed such that they face each other in the balun as shown in FIGS. 9A and 9B, each pair of the microstrip center conductors, dielectric layers and ground plates can be arranged as shown in FIG. 7 or 8, and a pair of the baluns with such an arrangement can be combined. In this case, the thickness of the unbalanced circuit portion can be made thinner.

Although the balanced lines 8 and 30 are constructed such that the planes including their conductors are orthogonal to each other, they can be disposed such that they form an obtuse angle. With such an arrangement, three pairs of balanced lines can constitute the balun, for example.

Figure 10:
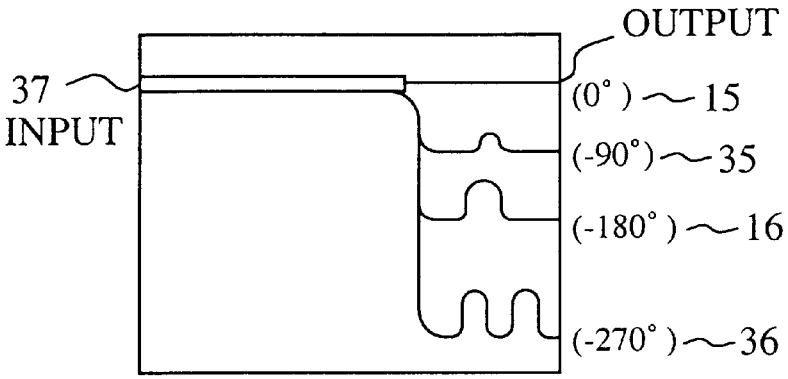
FIG. 10 is a diagram showing a 1-to-4 splitting microstrip line constituting a signal input circuit to the embodiment 4 of the balun in accordance with the present invention.

FIG. 10 is a schematic diagram showing a 1-to-4 splitting delay microstrip line for supplying the four microstrip center conductors of FIGS. 9A and 9B with input signals. A microstrip line from the signal input terminal 37 is split into four lines: one line with a phase of 0 degrees; and the remaining three lines with a phase 90 degrees each shifted through delay lines. The four outputs are connected to the signal input terminals 15, 35, 16 and 36 of FIG. 9A.

Figure 11A:
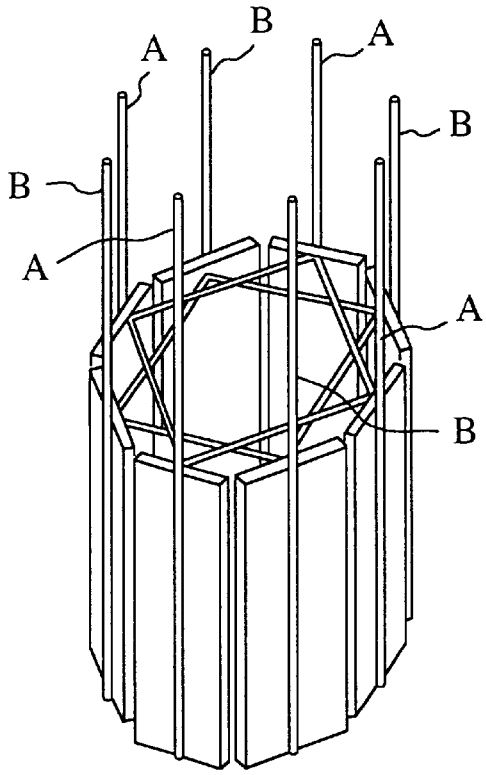
FIGS. 11A and 11B a perspective view and a plane view of another structure of the embodiment 4 of the balun in accordance with the present invention.
Figure 11B:
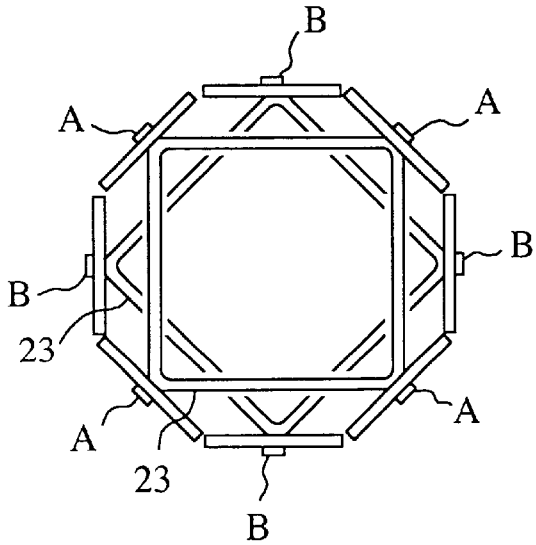

FIGS. 11A and 11B are views showing a structure comprising two sets of balanced lines arranged as shown in FIGS. 9A and 9B for generating circularly polarized waves, in which two sets A and B of the baluns are depicted. The two sets can constitute a double-frequency circularly polarized wave balun when they are supplied with signals of different frequencies. The connecting conductor 23 for connecting the ground plates of the set A and the connecting conductor 23 for connecting the ground plates of the set B are not connected electrically, although they seem to intersect in this figure.

Figure 12A:
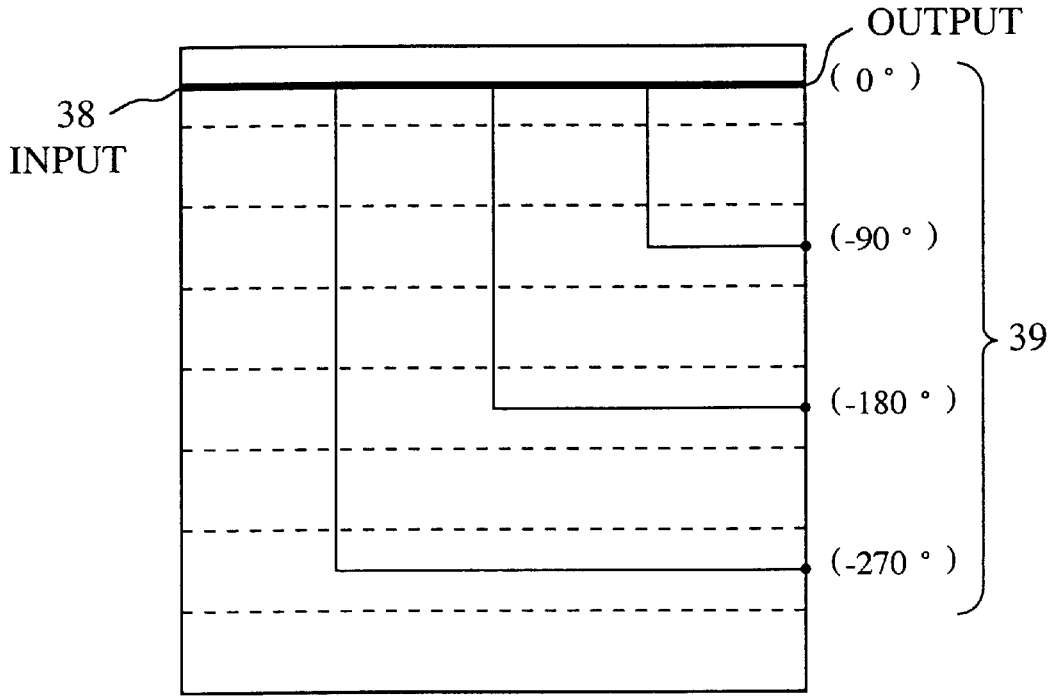
FIGS. 12A and 12B are an extended view and a perspective view showing a 1-to-4 splitting microstrip line constituting a signal input circuit to the embodiment 4 of the balun in accordance with the present invention.
Figure 12B:
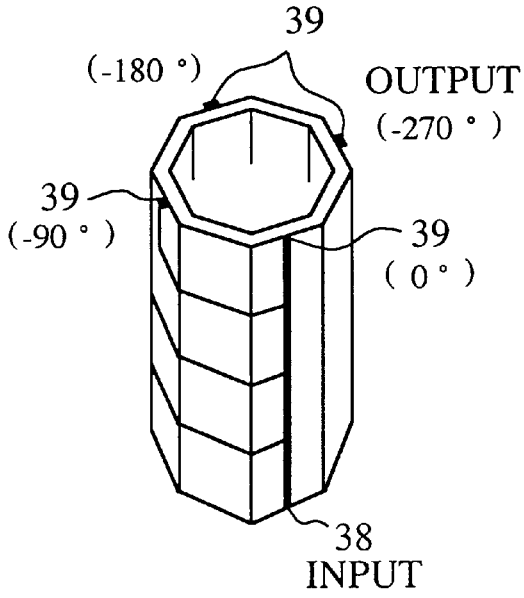

FIGS. 12A and 12B are views showing a structure of a feeder to the double-frequency circularly polarized wave balun, which is composed of a 1-to-4 splitting microstrip line. As shown in FIG. 12A, the microstrip line starting from a signal input terminal 38 is split into four lines to form a microstrip line for delaying phases according to distances to signal output terminals 39. An octagonal pipe as shown in FIG. 12B is constructed by bending the board. The four phase signal output terminals are placed at about the center of the edges of every other four sides of the octagonal pipe. By connecting the 1-to-4 splitting circuit to the signal input terminals of the double-frequency circularly polarized wave balun, the number of the signal input terminals for one frequency balun can be reduced to one. Incidentally, in FIGS. 12A and 12B, the microstrip line is formed on a dielectric board, on the inside wall of which a ground plate is formed.

Figure 13B:
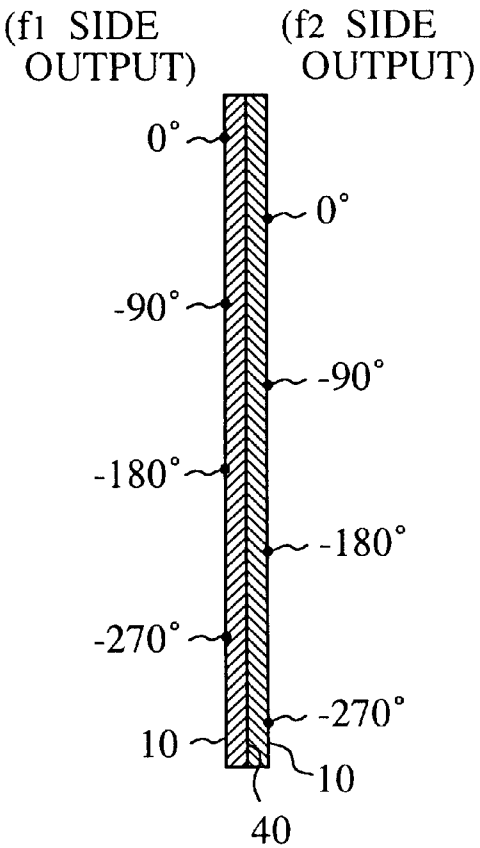
FIGS. 13A and 13B are an extended view and a cross-sectional view showing a double 1-to-4 splitting microstrip line constituting a signal input circuit to the embodiment 4 of the balun in accordance with the present invention.
Figure 13A:
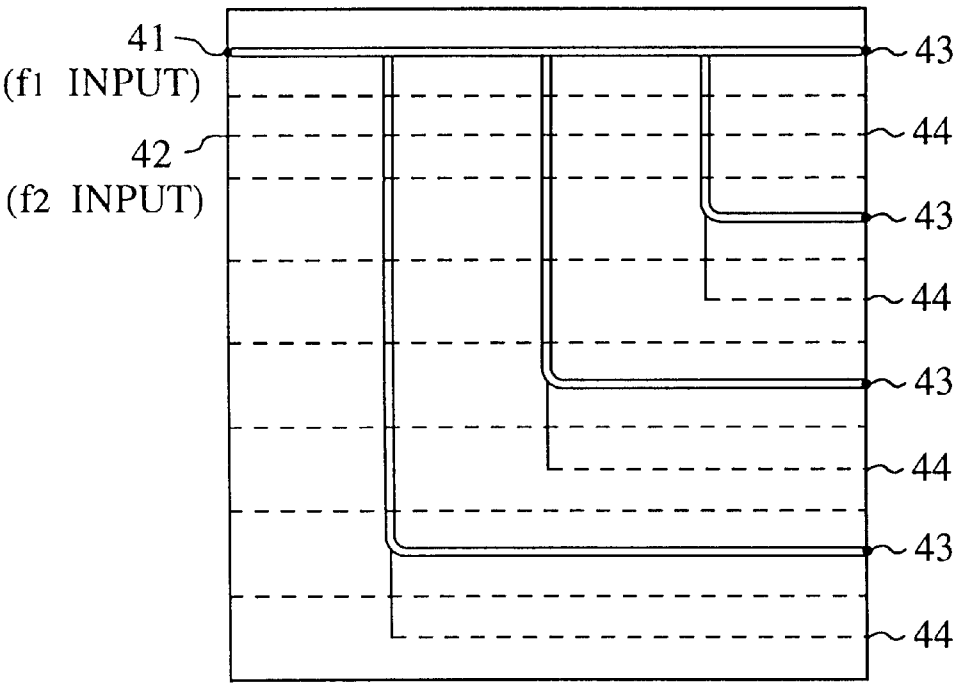

FIGS. 13A and 13B are views showing a feeder to the double-frequency circularly polarized wave balun, which is composed of a double 1-to-4 splitting microstrip line. In FIG. 13B, the reference numeral 40 designates a ground plate, on both sides of which dielectric layers are attached to form a board. A 1-to-4 splitting microstrip line is formed on both surfaces of the board. In FIG. 13A, the microstrip line starting from a signal input terminal 41 is split into four lines to form a microstrip line for delaying its phase according to the distance to four signal output terminals 43. Likewise, the microstrip line starting from a signal input terminal 42 is split into four lines to form a microstrip line for delaying its phase according to the distance to four signal output terminals 44. A feeder to the double-frequency circularly polarized wave balun is constructed by bending the board into an octagonal pipe such that the eight signal output terminals 43 and 44 are placed at the center of edges of its sides. The feeder can reduce the number of signal input terminals to one per frequency, that is, the number of signal input terminals to the double-frequency circularly polarized wave balun to two.

Figure 14A:
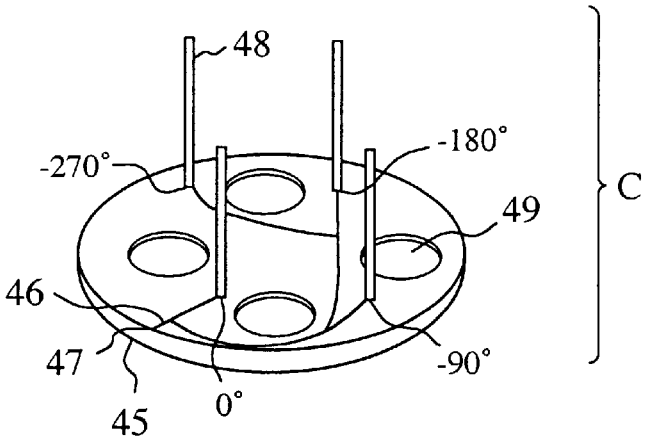
FIGS. 14A–14C are perspective views showing another structure of the embodiment 4 of the balun in accordance with the present invention.
Figure 14B:
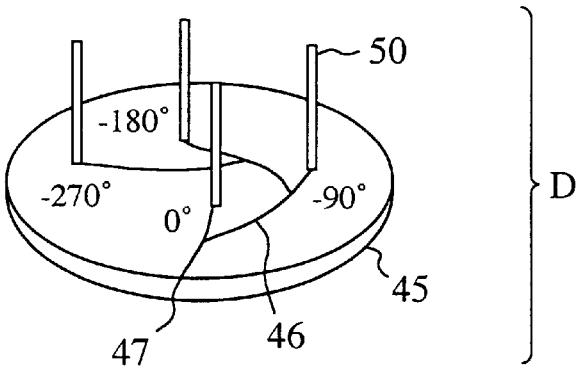
Figure 14C:
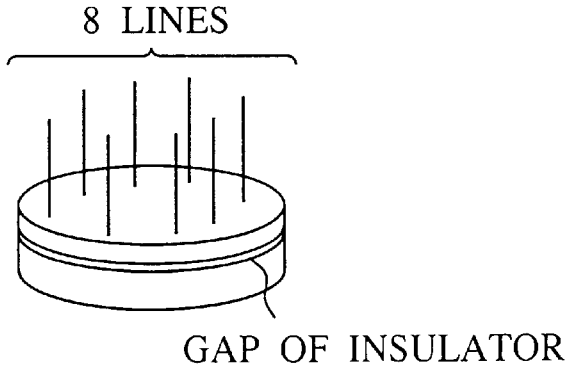

FIGS. 14A–14C are views showing a double-frequency circularly polarized wave balun that is composed by combining a couple of baluns with an unbalanced circuit section being placed on a surface for generating circularly polarized waves. In FIG. 14A, the reference numeral 45 designates a ground plate; 46 designates a microstrip line formed on the ground plate via a dielectric layer; 47 designates a signal input terminal to the microstrip line 46; and 48 designates a couple of balanced lines consisting of four conductors for generating a circularly polarized wave. The microstrip line 46 seen from the signal input terminal 47 is split into four lines, so that their phases are shifted every 90 degrees at the inputs to the balanced lines 48. The reference numeral 49 designates four holes provided in the board consisting of the ground plate and dielectric layer. A balun C consisting of the foregoing elements is placed on a balun D with a structure like that of the balun C except for the holes 49 as shown in FIG. 14B, in which balanced lines 50 of the balun D are passed through the holes 49 provided in the balun C. In addition, the microstrip line on the balun D is insulated from the ground plate of the balun C by providing a space or by inserting an insulator between them.

When two signals with different frequencies are supplied to the baluns C and D, circularly polarized waves with different frequencies are generated in the balanced lines 48 and 50.

EMBODIMENT 5

Figure 15A:
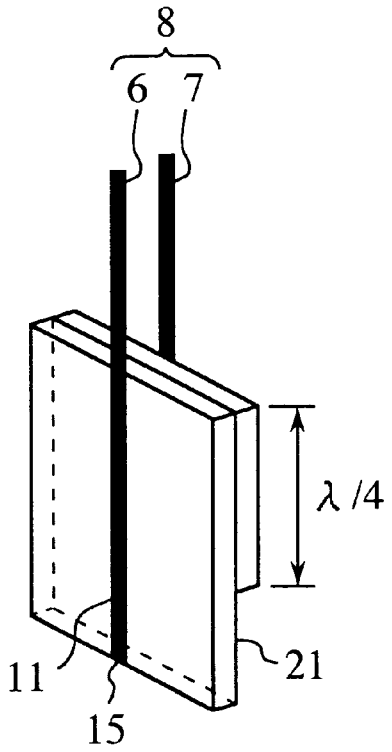
FIGS. 15A–15C are a perspective view, a cross-sectional view and a schematic operational diagram showing an embodiment 5 of the balun in accordance with the present invention.
Figure 15B:
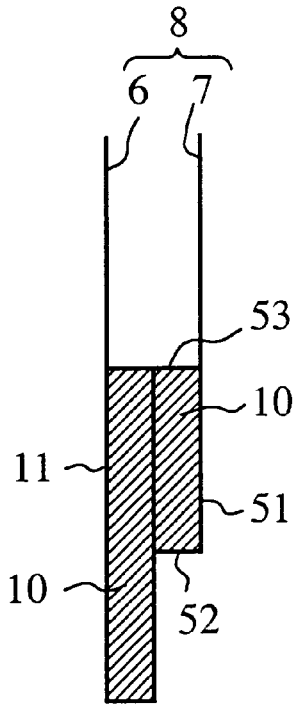
Figure 15C:
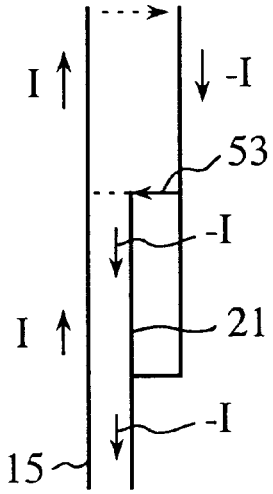

FIGS. 15A–15C are views showing another structure of the balun in accordance with the present invention, in which reference numerals 6 and 7 designate conductors; and the reference numeral 8 designates a balanced line consisting of the conductors 6 and 7. The reference numeral 11 designates a microstrip center conductor; 10 designates a dielectric layer; and 21 designates a ground plate corresponding to the microstrip center conductor 11. The reference numeral 51 designates a quarter wave long parallel plane, which is connected to the conductor 7 at its one end. The reference numeral 52 designates a short-circuit plate for short-circuiting the other edge of the parallel plane 51 to the ground plate 21; and 53 designates an open edge of the parallel plane 51.

Next, the operation of the balun will be described with reference to FIG. 15C. When a current I is supplied to the signal input terminal 15 of the microstrip center conductor 11, a current –I flows through the ground plate 21. The current I flowing into the conductor 6 causes a current –I to flow through the conductor 7 due to a displacement current. Although no current flows through the parallel plane 51 because it is a quarter-wave parallel plane circuit with its edge shorted, the current –I flowing through the conductor 7 flows through the ground plate via a displacement current at the open edge 53 of the parallel plane 51. Thus, the current supplied to the signal input terminal 15 flows with forming a closed loop, so that the balanced current flows in the opposite direction in the balanced line 8. This has an advantage of being able to obviate the necessity for generating the opposite phase signals at the signal input of the balun.

Figure 16:
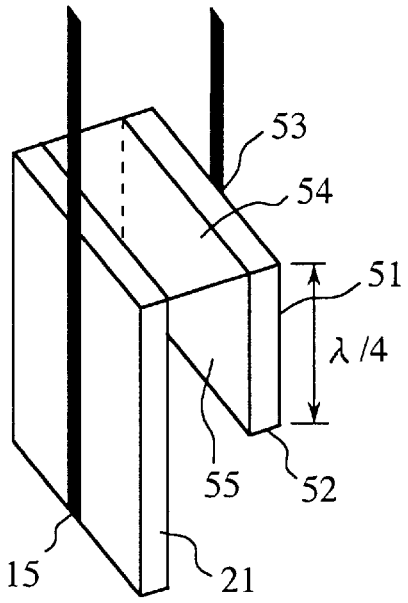
FIG. 16 is a perspective view showing another structure of the embodiment 5 of the balun in accordance with the present invention.

Alternatively, a configuration as shown in FIG. 16 is possible in which the ground plate 21 and the parallel plane 51 are connected by a conductor 54. In this case, a parallel plane 55 is provided such that it is parallel to the ground plate, and is short-circuited with the parallel plane 51. An edge of the parallel plane 55 is connected to the ground plate 21 by the conductor 54. A signal supplied to the signal input terminal 15 causes a displacement circuit at the open edge of the parallel plane 51 as in the foregoing configuration as shown in FIG. 15, thereby causing a current to flow through the balanced line 8. This configuration has an advantage of being able to provide spaces between the conductors constituting the balanced line.

Figure 17:
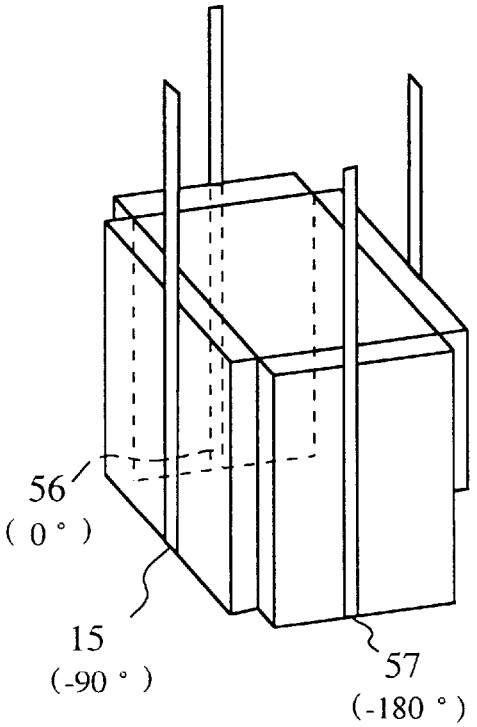
FIG. 17 is a perspective view showing a still another structure of the embodiment 5 of the balun in accordance with the present invention.
Figure 18:
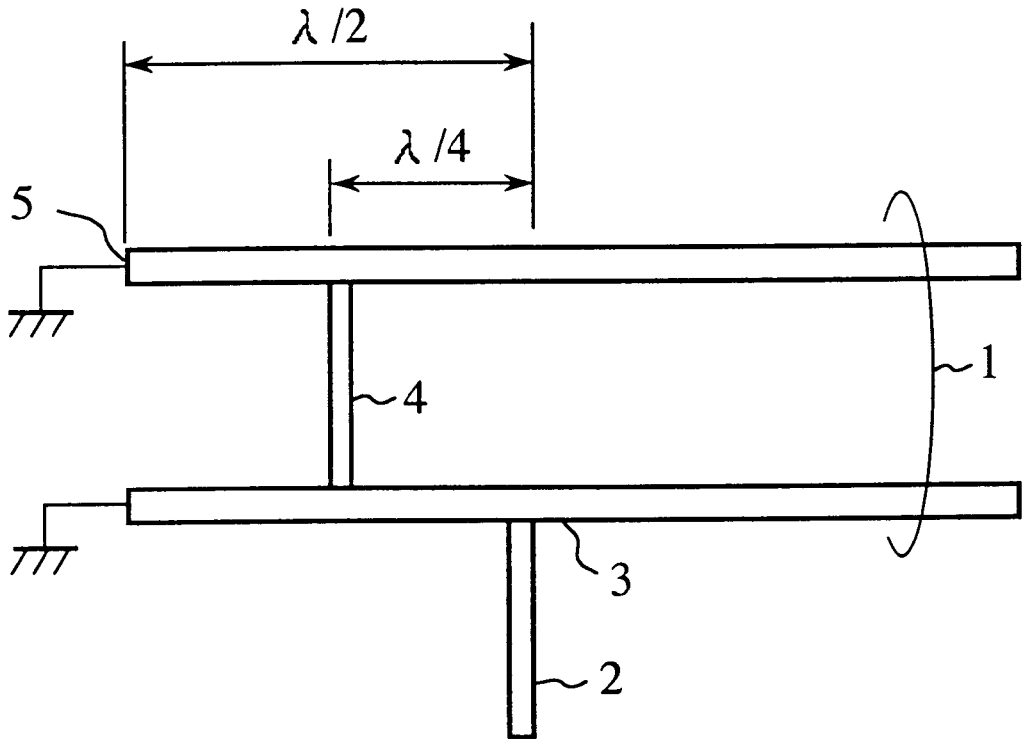
FIG.18 (PRIOR ART)
FIG. 18 is a schematic diagram showing a structure of a conventional balun.

FIG. 17 shows a balun arranged by combining the balun as shown in FIG. 16 with the balun as shown in FIG. 4. The signal input terminals of the balun as shown in FIG. 17 are three points denoted by 56, 15 and 57, to which three signals are supplied with their phase shifted by 0, –90 and –180 degrees, for example. This enables a vector of a displacement current generated in the balanced line to rotate, thereby generating a circularly polarized wave.

As described above, the balun in accordance with the present invention is suitable to construct a small, frequency independent balun for converting into a balanced current an unbalanced current flowing through a microstrip line which is employed as a transmission circuit for transmitting a signal when a high frequency band is used in electric communications.

What is claimed is:

1. A balun comprising a plurality of balun components, each of which includes:

a balanced line including a first conductor and a second conductor;

a first microstrip center conductor connected to the first conductor of said balanced line; and a second microstrip center conductor connected to the second conductor of said balanced line for supplying the second conductor with a current with a phase opposite to a phase of a current flowing through the first conductor, wherein two phases of a radio wave fed to one of said balun components differ from two phases of a radio wave fed to another of said balun components, and wherein said one of said balun components comprises for its two microstrip center conductors two around plates facing each other, and said another of said balun components comprises for its two microstrip center conductors two ground plates facing each other and disposed alternately with said ground plates of said one of said balun components, and wherein the four ground plates adjacent to each other are connected by a conductor.

2. The balun according to claim 1, wherein the four microstrip center conductors of each of said balun components are respectively connected to one additional microstrip center conductor and three delay microstrip center conductors each including a delay line branching from said one additional microstrip center conductor.

* * * * *

UNITED STATES PATENT AND TRADEMARK OFFICE

CERTIFICATE OF CORRECTION

PATENT NO. : 6,211,751 B1
DATED : April 3, 2001
INVENTOR(S) : Katsuhiko Aoki

It is certified that error appears in the above-identified patent and that said Letters Patent is hereby corrected as shown below:

Column 10,
Line 36, delete "around" and replace with -- ground --.

Signed and Sealed this

Twenty-first Day of May, 2002

*Attest:*

*Attesting Officer*

JAMES E. ROGAN
*Director of the United States Patent and Trademark Office*